US011148760B2

(12) United States Patent
Haynes et al.

(10) Patent No.: US 11,148,760 B2
(45) Date of Patent: Oct. 19, 2021

(54) FLOTATION DEVICE WITH BOARDING APPARATUS

(71) Applicant: GOODRICH CORPORATION, Charlotte, NC (US)

(72) Inventors: Timothy C Haynes, Prescott Valley, AZ (US); Drew Hartman, Phoenix, AZ (US); Rachel Burt, Tempe, AZ (US); John Markovic, Peoria, AZ (US); Eric Folland, Tempe, AZ (US); Philip E Burbank, Tempe, AZ (US); Michael Jacob Robb, Glendale, AZ (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 16/460,170

(22) Filed: Jul. 2, 2019

(65) Prior Publication Data

US 2021/0001959 A1 Jan. 7, 2021

(51) Int. Cl.

| | |
|---|---|
| ***B63B 17/00*** | (2006.01) |
| ***B63B 27/14*** | (2006.01) |
| ***B63C 9/26*** | (2006.01) |

(52) U.S. Cl.

CPC ..... *B63B 27/146* (2013.01); *B63C 9/26* (2013.01)

(58) Field of Classification Search

CPC ..... B63B 27/00; B63B 27/19; B63B 27/14; B63B 27/141; B63B 27/146; B63C 9/00; B63C 9/21; B63C 9/26

USPC ..... 114/343, 345, 362, 364; 441/35, 39, 40

See application file for complete search history.

(56) References Cited

U.S. PATENT DOCUMENTS

| | | | | |
|---|---|---|---|---|
| 2,367,902 | A * | 1/1945 | Taylor | B63C 9/04 441/38 |
| 2,764,766 | A * | 10/1956 | Boyle | B63C 9/04 441/38 |
| 2,804,633 | A * | 9/1957 | Taylor | B63C 9/02 441/38 |
| 3,072,930 | A | 1/1963 | Fraebel | |
| 3,092,854 | A * | 6/1963 | Manhart | B63C 9/02 441/38 |
| 3,216,030 | A | 11/1965 | Garfield | |
| 4,405,034 | A | 9/1983 | Dunne | |
| 4,723,929 | A * | 2/1988 | Parish | B63C 9/04 114/362 |
| 5,074,236 | A * | 12/1991 | Robertson | B63B 27/14 114/362 |

(Continued)

OTHER PUBLICATIONS

Knot of the Week: How to Tie an Etrier and Create a Field Expedient Lad by the ITS Crew dated May 31, 2011 and published online at: https://www.itstactical.com/skillcom/knots/loops/knot-of-the-week-how-to-tie-an-etrier-and-create-a-field-expedient-ladder/.

(Continued)

*Primary Examiner* — Daniel V Venne

(74) *Attorney, Agent, or Firm* — Snell & Wilmer L.L.P.

(57) ABSTRACT

A boarding apparatus for use on a flotation device, in accordance with various embodiments is disclosed herein. The boarding apparatus comprises a stirrup ladder. The boarding apparatus may be integral to a lifeline assembly of the flotation device. The boarding apparatus may be removably coupled to a loop patch of the flotation device. The boarding apparatus may release from the loop patch and become a boarding configuration for the flotation device.

5 Claims, 6 Drawing Sheets

(56) References Cited

U.S. PATENT DOCUMENTS

| | | | | |
|---|---|---|---|---|
| 5,540,178 | A * | 7/1996 | Damron | B63B 27/14 114/362 |
| 5,800,225 | A * | 9/1998 | Shoaff, III | B63C 9/02 114/39.14 |
| 5,848,667 | A * | 12/1998 | Davidson | B63B 27/14 182/190 |
| 6,357,551 | B1 * | 3/2002 | Bogardus, III | E06C 1/56 182/190 |
| 6,394,867 | B1 * | 5/2002 | Bianco | B63C 9/04 114/360 |
| 7,585,197 | B1 * | 9/2009 | Merten | B63B 27/146 182/136 |
| 9,962,990 | B2 * | 5/2018 | Russell | B44C 5/02 |
| 2007/0270059 | A1 | 11/2007 | Schloegel | |
| 2017/0320583 | A1 | 11/2017 | Schmidt et al. | |
| 2018/0210483 | A1 | 7/2018 | Santiago | |

OTHER PUBLICATIONS

European Patent Office, European Search Report dated Jul. 21, 2020 in Application No. 19216190.9.

* cited by examiner

FLOTATION DEVICE WITH BOARDING APPARATUS

FIELD

The present disclosure relates to aircraft evacuation assemblies, and more specifically to flotation devices having an integrated stirrup ladder.

BACKGROUND

In the event of an emergency water landing, aircraft typically have one or more flotation devices (e.g., life rafts) that can be deployed to hold evacuated passengers. To permit unassisted entry to the flotation device, flotation devices often include boarding aids. Additionally, lifelines are often included on flotation devices to permit a user to secure him or herself to the life raft. In the event of a person going overboard, it is beneficial to have a rescue ladder readily accessible to assist in bringing the person from the water onto the inflatable structure safely.

SUMMARY

A flotation device, in accordance with various embodiments, is disclosed herein. A flotation device comprises an inflation tube; a first loop patch coupled to the inflation tube; and a boarding apparatus. The boarding apparatus comprises: a central rope having a first end and a second end, the first end coupled to the first loop patch; a first loop proximate the first loop patch and disposed on a first side of the central rope; a second loop proximate the first loop and disposed on a second side of the central rope, the second side being opposite the first; and a third loop proximate the second loop and disposed on the first side of the central rope.

In various embodiments, the flotation device may further comprise a second loop patch, wherein the second loop patch is disposed adjacent to the first loop patch along a perimeter of the inflation tube, the second end of the central rope removably coupled to the second loop patch. The second end of the central rope may be removably coupled to the second loop patch by at least one of a slipknot or a pin release system. The second loop may be disposed between the first loop and the second loop. The first loop may extend from a first knot disposed on the central rope proximate the first end to a second knot on the central rope, wherein the second knot is adjacent to the first knot. The second loop may extend from the second knot to a third knot on the central rope, wherein the third knot is adjacent to the first knot. The flotation device may further comprise a lifeline assembly disposed along a portion of the perimeter of the inflation tube, wherein the lifeline assembly comprises the boarding apparatus. The flotation device may further comprise a plurality of loop patches, the plurality of loop patches including the first loop patch and the second loop patch, wherein the lifeline assembly extends between adjacent loop patches in the plurality of loop patches. The boarding apparatus may further comprise a heat shrink tubing, wherein the heat shrink tubing is coupled to the first loop. The heat shrink tubing may extend substantially perpendicular to the central rope proximate the second knot.

A flotation device, in accordance with various embodiments, is disclosed herein. The flotation device comprises: an inflation tube; a plurality of loop patches disposed around a perimeter of the inflation tube; and a lifeline assembly. The lifeline assembly comprises: a lifeline extending from adjacent loop patches in the plurality of loop patches; and a boarding apparatus extending between a first loop patch in the plurality of loop patches and a second loop patch in the plurality of loop patches, the boarding apparatus being removably coupled to the second loop patch.

In various embodiments, the boarding apparatus may comprise a stirrup ladder and be configured to release from the second loop patch into a boarding configuration. An applied force along an axis of the boarding apparatus may release the boarding apparatus from the second loop patch. The boarding apparatus may further comprise: a central rope having a first end and a second end, the first end coupled to the first loop patch; a first loop proximate the first loop patch and disposed on a first side of the central rope; a second loop proximate the first loop and disposed on a second side of the central rope, the second side being opposite the first; and a third loop proximate the second loop and disposed on the first side of the central rope. The boarding apparatus may further comprise a heat shrink tubing, wherein the heat shrink tubing is coupled to the first loop.

A method of integrating a boarding apparatus on a lifeline assembly of a flotation device, in accordance with various embodiments, is disclosed herein. The method comprises: folding a lifeline in half to form a bight at a second end of the lifeline, the lifeline comprising a first half and a second half; tying a first overhand knot at a first end of the lifeline; pulling a portion of the first half longer than a portion of the second half; tying a second overhand knot adjacent to the first overhand knot to form a first loop on a first side of the lifeline; pulling a portion of the second half longer than a portion of the first half; and tying a third overhand knot adjacent to the second overhand knot to form a second loop on a second side of the lifeline, the second side being opposite the first side.

In various embodiments, the method may further comprise prior to step folding the lifeline in half: disposing a heat shrink tubing on a portion of the lifeline. The method may further comprise prior to step tying the second overhand knot: aligning the heat shrink tubing within the first loop. The method may further comprise heating the heat shrink tubing to form a stiff portion of the first loop. The method may further comprise repeating the following steps until the second end of the lifeline is reached: pulling a portion of the first half longer than a portion of the second half; tying a fourth overhand knot adjacent to the third overhand knot to form a third loop on the first side of the lifeline; pulling a portion of the second half longer than a portion of the first half; and tying a fifth overhand knot adjacent to the fourth overhand knot to form a fourth loop on the second side of the lifeline.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
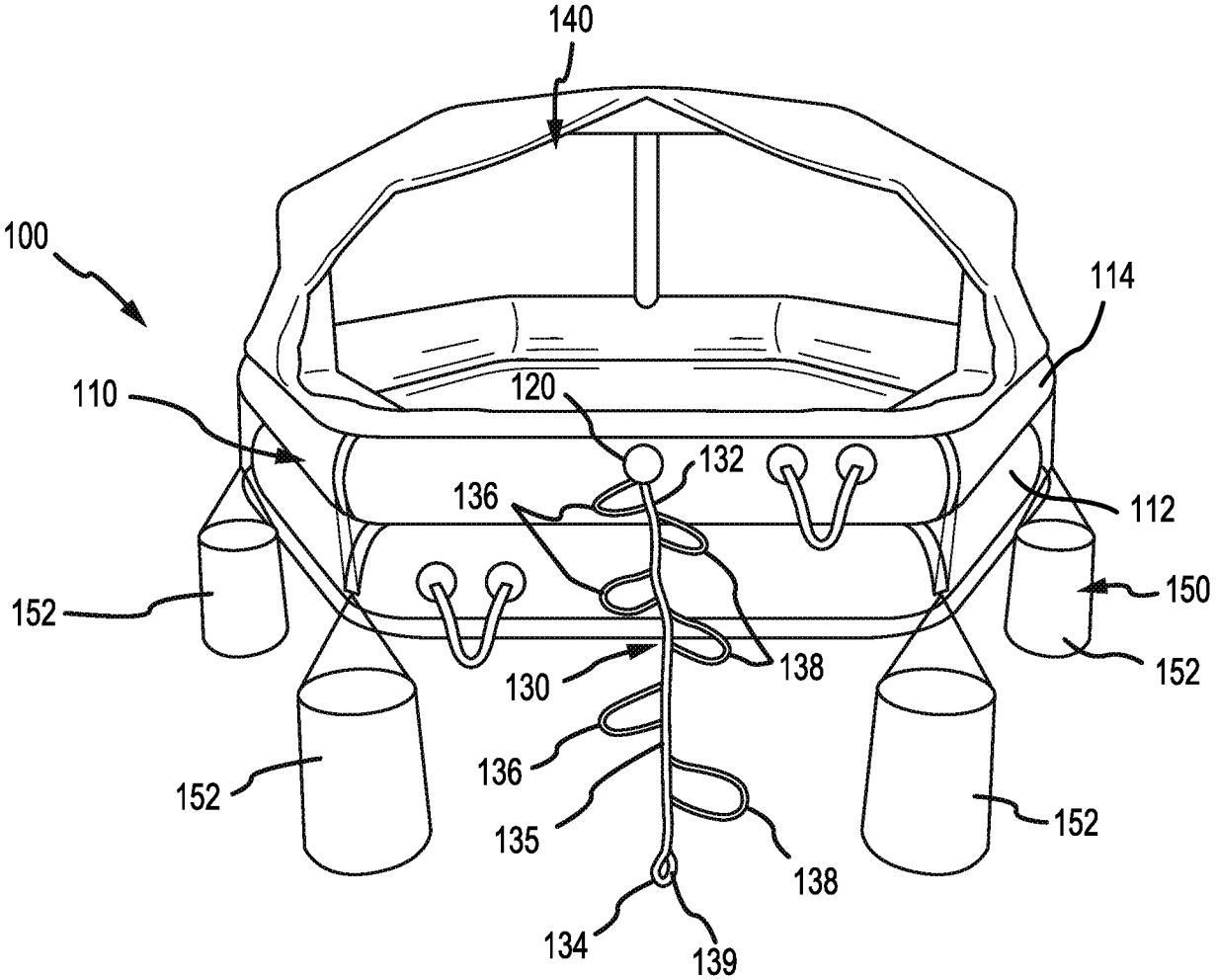
FIG. 1 is a perspective view of a flotation device with a stirrup ladder, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation. Throughout the present disclosure, like reference numbers denote like elements. Accordingly, elements with like element numbering may be shown in the figures but may not be necessarily be repeated herein for the sake of clarity.

In the event of an emergency water landing, aircraft typically have one or more life rafts that can be deployed to hold evacuated passengers. To protect passengers to who fall overboard of the life raft, life rafts include a boarding device, which enables an overboard passenger to re-board the life raft. Also, to protect passengers who fall overboard, various life rafts include lifelines around its perimeter, allowing overboard passengers to hang on to the lifeline and remain close to the life raft. Disclosed herein, according to various embodiments, is a flotation device that includes a lifeline integrated boarding apparatus to provide both a lifeline to remain close to the life raft and a ladder to re-board the life raft. Additionally, disclosed herein is a flotation device having a boarding apparatus comprising, for example, a stirrup ladder to more easily allow an overboard passenger to re-board or board the life raft. Said differently, the flotation device provided herein may be deployed without conventional boarding assembly, thus decreasing the complexity of the life raft, decreasing the weight of the life raft, and decreasing the cost of the life raft, according to various embodiments.

In various embodiments, and with reference to FIG. 1, a flotation device 100, in an inflated state, in accordance with various embodiments is depicted. A flotation device 100 comprises a flotation platform 110, a loop patch 120, and a boarding apparatus 130. The flotation platform 110 is for carrying and supporting at least one occupant. In various embodiments, the flotation platform 110 comprises a first inflation tube 112 and a second inflation tube 114. The second inflation tube 114 may be disposed above first inflation tube 112 and suitably bonded to first inflation tube 112. In various embodiments, one or both of the first inflation tube 112 and the second inflation tube 114 is compartmentalized such that the flotation platform 110 comprises several segments or compartments extending about a circumference of the flotation platform 110. A flexible floor may be disposed at the bottom of the second inflation tube 114 and suitably bonded thereto. The loop patch 120 is bonded to the second inflation tube 114 by any suitable method known in the art.

In various embodiments, the boarding apparatus 130 comprises a stirrup ladder. The boarding apparatus 130 may be coupled to the loop patch 120 by any method known in the art. The boarding apparatus 130 comprises a first end 132 and a second end 134. The boarding apparatus comprises a central rope 135, a first plurality of loops 136 and a second plurality of loops 138. The first plurality of loops 136 are disposed on a first side of the central rope 135. The second plurality of loops 138 are disposed on a second side of the central rope 135, the second side being opposite the first side. Each loop in the first plurality of loops 136 is adjacent to a respective loop in the first plurality of loops 136. Similarly, each loop in the second plurality of loops 138 is adjacent to a respective loop in the second plurality of loops 138. In various embodiments, the first plurality of loops 136 is offset from the second plurality of loops 138. In various embodiments, the first plurality of loops 136 are aligned with the second plurality of loops 138. In various embodiments, the second end of the central rope 135 comprises an end loop 139. In various embodiments, the end loop 139 is configured to engage a second loop patch, or a similar component coupled to the flotation platform 110.

The boarding apparatus 130 is configured to allow an individual who wants to board the flotation device 100 to climb up the boarding apparatus 130 and into the flotation device 100. The first plurality of loops 136 and the second plurality of loops 138 provide an individual with footholds to climb up the boarding apparatus 130. The boarding apparatus 130, as depicted, may ensure that the boarding apparatus 130 does not deform during boarding of the flotation device 100.

In various embodiments, the flotation device 100 further comprises a canopy structure 140. The canopy structure 140 is disposed at the top of the second inflation tube 114 and suitably bonded thereto. In various embodiments, the flotation device 100 further comprises a ballast bag system 150 comprising a plurality of ballast bags 152. The plurality of ballast bags 152 allow water, e.g., sea water—to flow into an interior portion of each ballast bag in the plurality of ballast bags 152. In various embodiments, the plurality of ballast bags 152 are disposed around a circumference of the flotation platform 110. The ballast bag system 150 provides stability to the flotation device 100 in response to wind and waves, as a result, provides greater resistance to rolling movement of the flotation device 100 than without the ballast bag system 150. Additionally, the ballast bag system 150 provides greater stability to an individual utilizing the boarding apparatus 130.

Figures 2A, 2B:
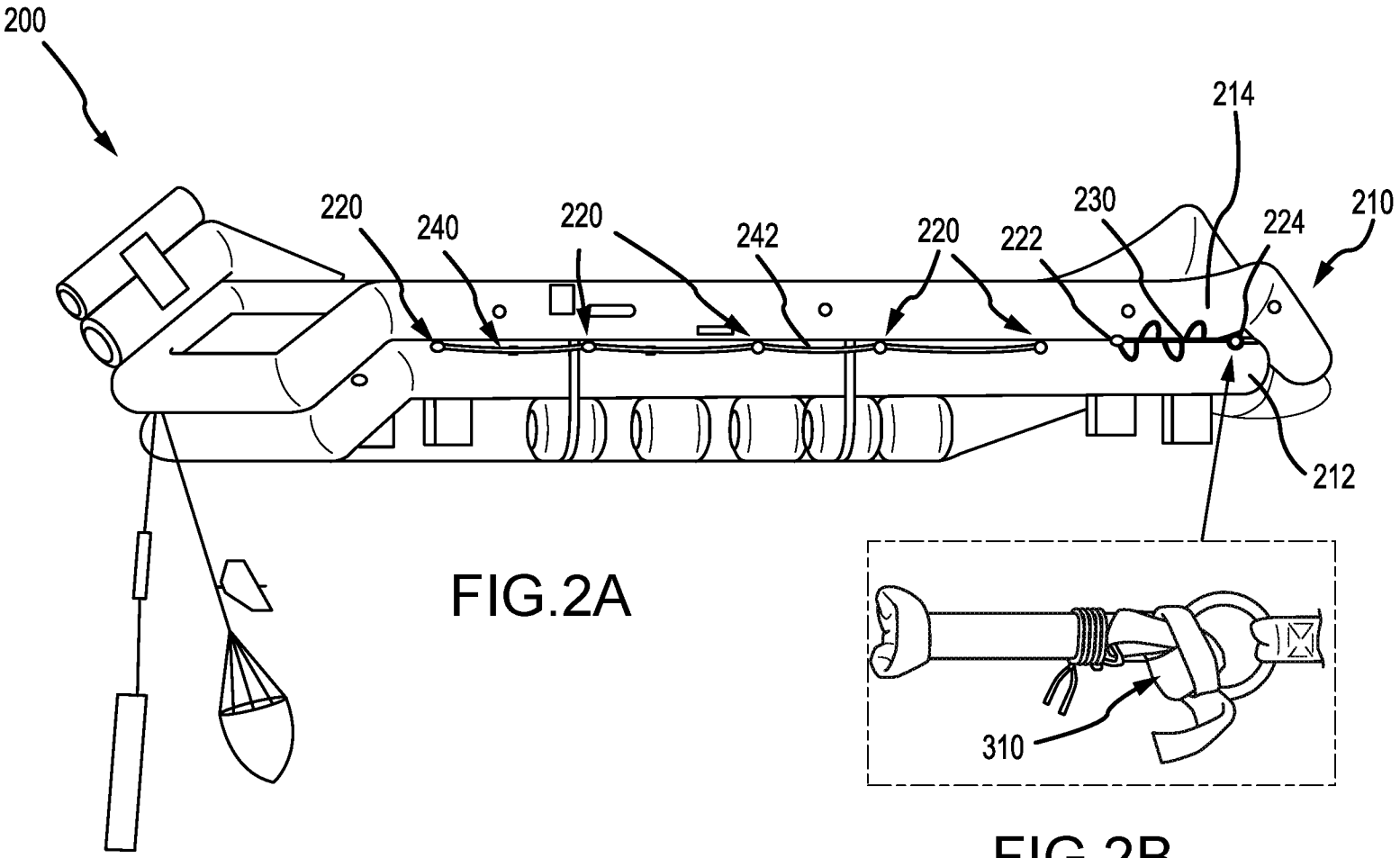
FIG. 2A is a side view of a flotation device with an integrated stirrup ladder in a first position, in accordance with various embodiments.
FIG. 2B is a boarding apparatus connection to a flotation device, in accordance with various embodiments.

Referring now to FIG. 2A, a side view of a flotation device 200 in an inflated state with a lifeline assembly 240, in accordance with various embodiments, is depicted. In various embodiments, flotation device 200 comprises a life raft. In various embodiments, flotation device 200 comprises an evacuation slide. The flotation device 200 comprises a flotation platform 210 a first loop patch 222, a second loop patch 224, and a boarding apparatus 230. In various embodiments, the boarding apparatus 230 comprises a stirrup ladder. The boarding apparatus 230 is fixedly coupled to the first loop patch 222 by any method known in the art. The boarding apparatus 230 is removably coupled to the second loop patch 224 by any method known in the art. In various embodiments, the boarding apparatus 230 has the features described above with respect to boarding apparatus 130 and FIG. 1.

In various embodiments, the flotation device 200 further comprises a plurality of loop patches 220 and a lifeline assembly 240. The plurality of loop patches 220 include the first loop patch 222 and the second loop patch 224. The plurality of loop patches 220 are disposed around the perimeter of the flotation platform 210. In various embodiments, the flotation platform 210 comprises a first inflation tube 212 and a second inflation tube 214. In various embodiments, the flotation device 200 comprises a single inflated tube. The plurality of loop patches may be coupled to the first inflation tube 212 and/or the second inflation tube 214 by any method known in the art, such as bonding or the like. In various embodiments, the lifeline assembly 240 comprises a first lifeline 242 and a second lifeline including the boarding apparatus 230. In various embodiments, the first lifeline 242 is fixedly coupled to the plurality of loop patches 220. In various embodiments, the lifeline assembly 240 may comprise a plurality of boarding apparatuses. In various embodiments, the lifeline assembly 240 comprises a single boarding apparatus. In various embodiments, the lifeline assembly comprises a plurality of lifelines and a boarding apparatus 230.

In FIG. 2A, boarding apparatus 230 is in a lifeline configuration. As referred to herein, a lifeline configuration may refer to having the boarding apparatus 230 extend from the first loop patch 222 along the perimeter of the flotation device 200 to the second loop patch 224. A lifeline configuration allows an overboard passenger to hang on to the boarding apparatus 230 and remain close to the flotation platform 210. In various embodiments, when the boarding apparatus 230 is in a lifeline configuration, a user may pull in a perpendicular direction to the boarding apparatus 230 and the boarding apparatus 230 will remain coupled to the first loop patch 222 and the second loop patch 224.

With reference now to FIG. 2B, the boarding apparatus 230 coupled to the second loop patch 224 is depicted. The boarding apparatus 230 is removably coupled to the second loop patch 224 by a slipknot 310. With reference now to FIGS. 2A and 2B, the slipknot 310 may support over 500 lbs. (227 kg) in the perpendicular direction to the boarding apparatus 230 without releasing the boarding apparatus 230. Additionally, the slipknot 310 may release the boarding apparatus 230 when a force greater than 10 lbs. (4.54 kg) is applied along the axis of the boarding apparatus 230 in a direction away from the second loop patch 224 and towards the first loop patch 222.

In various embodiments, the boarding apparatus 230 is removably coupled to the second loop patch 224 by a pin release system. For example, similar to the slipknot 310, a pin release system may support over 500 lbs. (227 kg) in the perpendicular direction to the boarding apparatus 230 without releasing the boarding apparatus 230. Additionally, a pin release system may release the boarding apparatus 230 when a force greater than 10 lbs. (4.54 kg) is applied along the axis of the boarding apparatus 230 in a direction away from the second loop patch 224 and towards the first loop patch 222. The removable connection of the boarding apparatus 230 to second loop patch 224 may be in accordance with any other removeable connection known in the art and still be within the scope of this disclosure. When in use, upon releasing the boarding apparatus 230 from the second loop patch 224, the boarding apparatus 230 drops and extends from the first loop patch downward and into the water. Downward, as defined herein, may refer to the general direction in which boarding apparatus 230 would extend in operation when it is in a boarding configuration.

Figure 3:
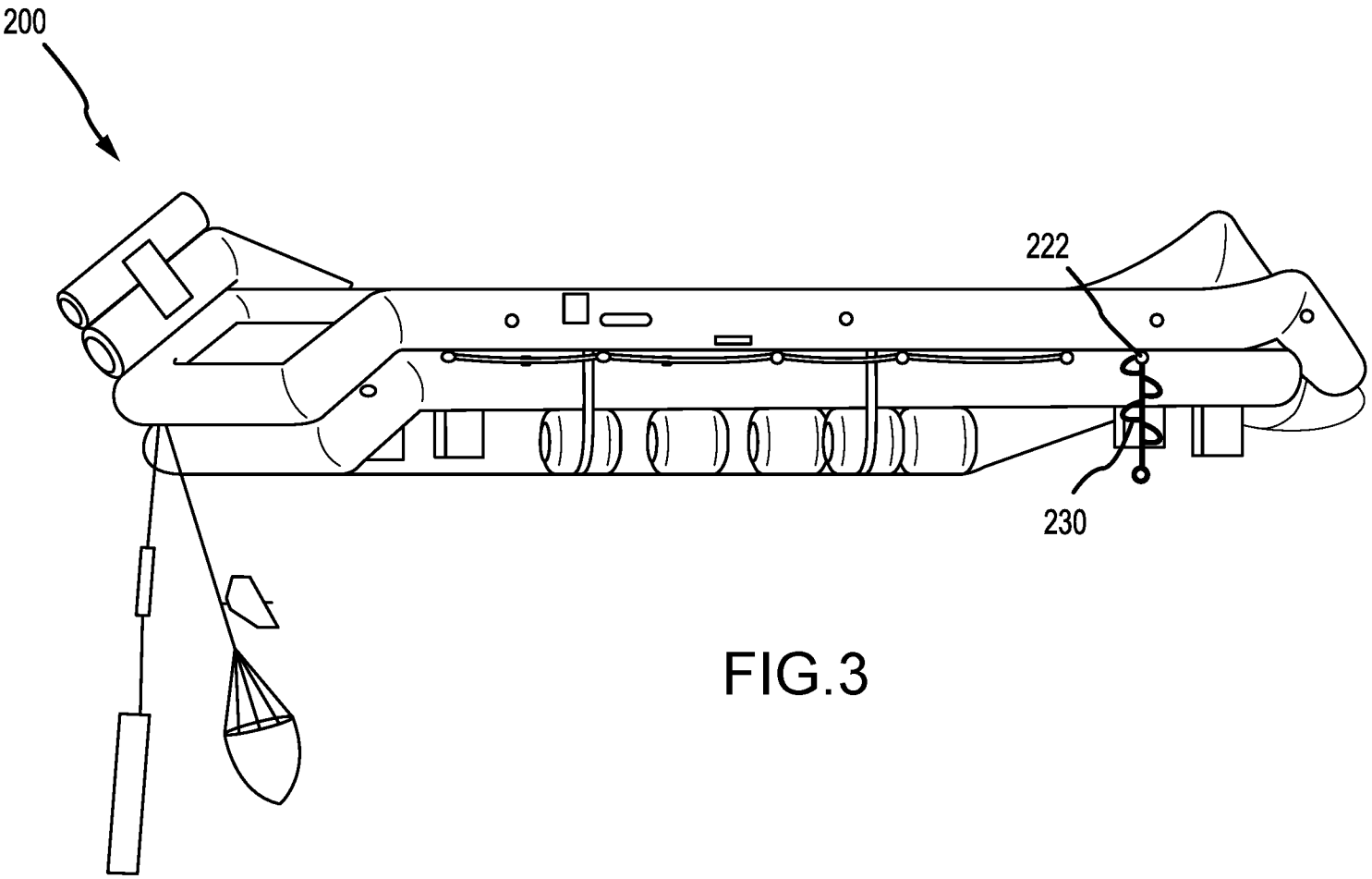
FIG. 3 is a side view of a flotation device with a boarding apparatus in a second position, in accordance with various embodiments.

Referring now to FIG. 3, a side view of a flotation device 200 in an inflated state, with an integrated lifeline/boarding apparatus in a boarding configuration, in accordance with various embodiments, is depicted. As referred to herein, a boarding configuration is when the boarding apparatus 230 extends from the first loop patch 222 downward and substantially perpendicular to the perimeter of the first inflation tube 212 of the flotation device 200 from FIG. 2A. In various embodiments, substantially perpendicular is between 60 degrees and 120 degrees below the horizontal line defined by the perimeter of the flotation device 200. In a boarding configuration, an overboard passenger may climb up the boarding apparatus 230 and enter the flotation device 200. In various embodiments, by having a stirrup ladder as the boarding apparatus 230, it may be easier for an overboard passenger to re-board the flotation device 200 because the stirrup ladder will deform the loop an overboard passenger places his or her foot in and not the rest of the ladder.

Figure 4:
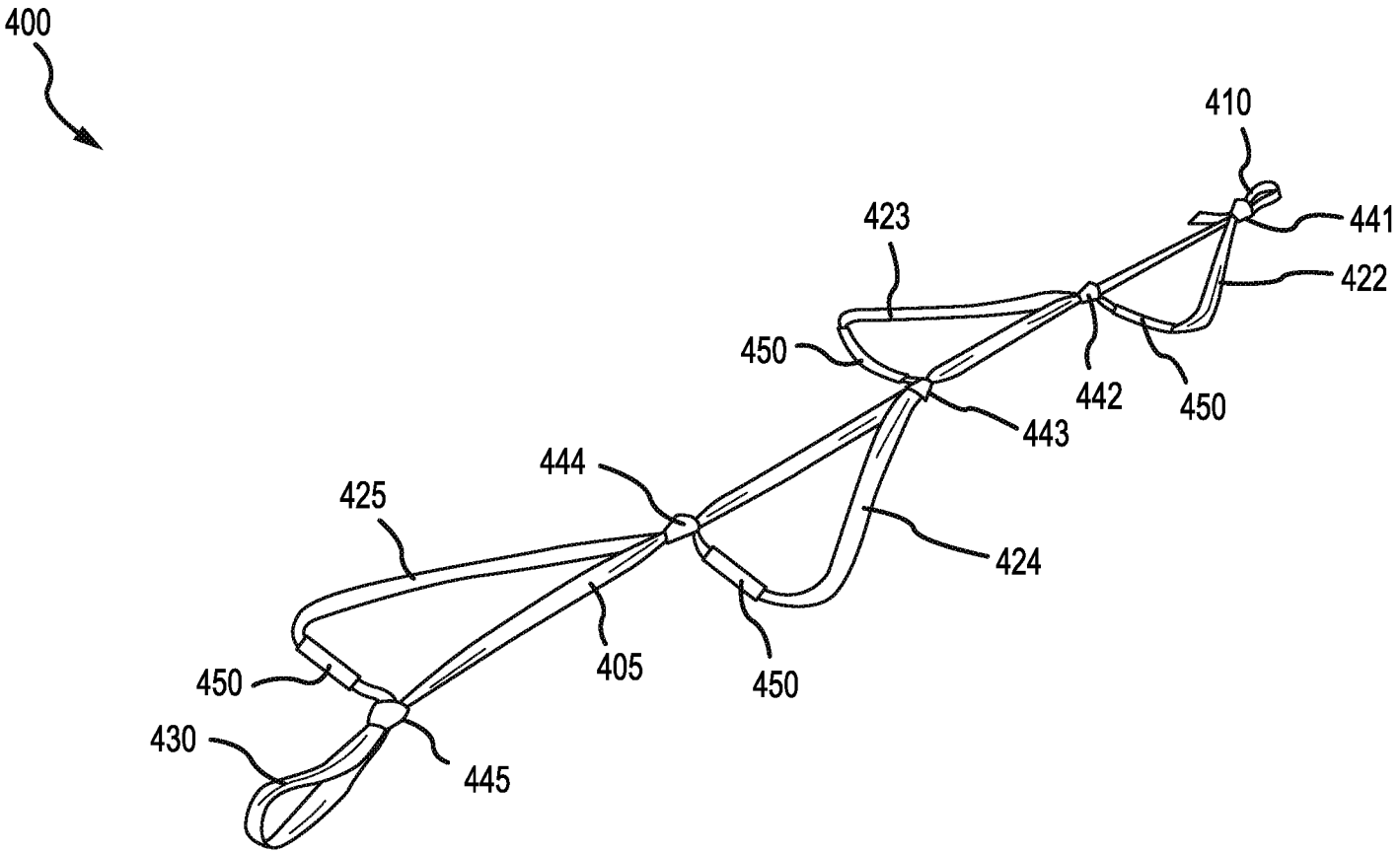
FIG. 4 is a perspective view of a boarding apparatus of a flotation device, in accordance with various embodiments.

Referring now to FIG. 4, a boarding apparatus 400, in accordance with various embodiments, is depicted. The boarding apparatus comprises a first end 410 and a second end 430. A central rope 405 extends from the first end 410 to the second end 430. In various embodiments, the first end 410 and the second end 430 may each comprise a loop. The boarding apparatus 400 further comprises a first loop 422 disposed proximate the first end 410 of the boarding apparatus 400. The first loop 422 extends from a first knot 441 outward from the central rope 405 along a first side of the central rope 405 and back to a second knot 442 disposed on the central rope 405. The boarding apparatus 400 further comprises a second loop 423 disposed proximate the first loop 422 of the boarding apparatus. The second loop 423 may extend from the second knot 442 outward from the central rope 405 along a second side of the central rope 405, the second side being opposite the first side of the central rope and back to a third knot 443. The boarding apparatus 400 further comprises a third loop 424 disposed proximate the second loop 423 and adjacent to the first loop 422. The third loop 424 may extend from the third knot 443 outward from the central rope along the first side of the central rope 405 and back to a fourth knot 444. The fourth loop 425 may extend from the fourth knot 444 outward from the central rope along the second side of the central rope 405 and back to a fifth knot 445. In various embodiments, a loop extends along an axis defined by the central rope 405 from fifth knot 445 at second end 430. Similarly, in various embodiments, a loop extends along the axis defined by the central rope 405 from the first knot 441 in an opposite direction to the loop at the second end 430.

In various embodiments, first loop 422, second loop 423, third loop 424, and fourth loop 425 may each comprise heat shrink tubing 450. In various embodiments, heat shrink tubing extends substantially perpendicular from a bottom knot of a loop. For example, heat shrink tubing 450 of the first loop 422 may extend substantially perpendicular to the central rope 405 from the second knot 442. Heat shrink tubing 450 may stiffen the boarding apparatus 400 and/or provide better grip when in use. Any type of heat shrink tubing known in the art may be utilized.

Figure 5:
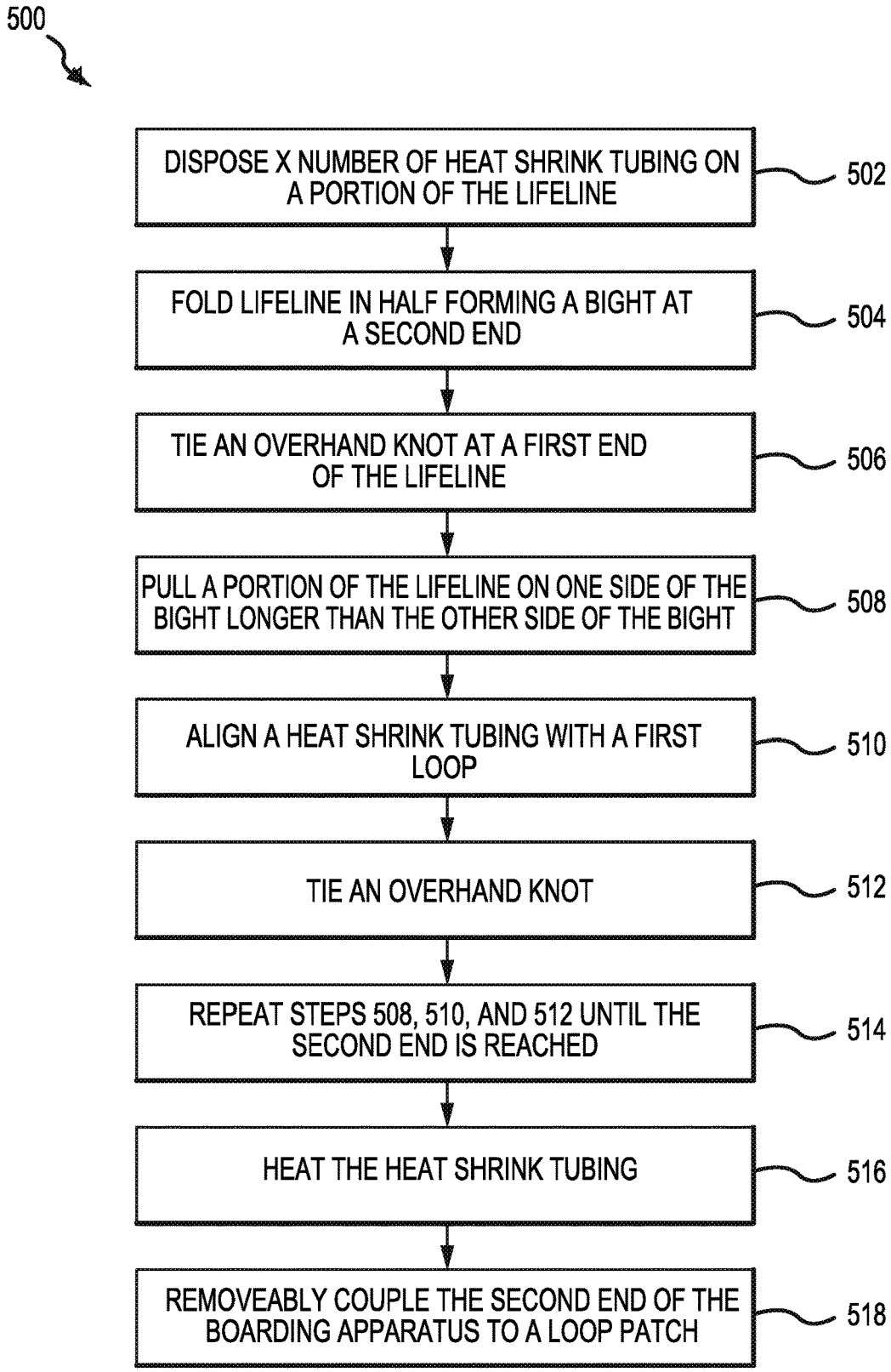
FIG. 5 is a method of integrating a boarding apparatus on a lifeline of a flotation device, in accordance with various embodiments.
Figure 6:
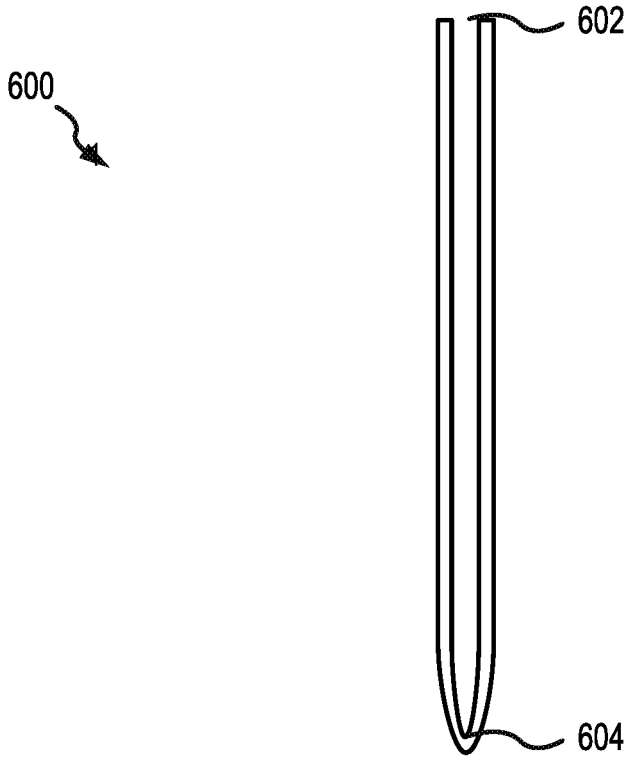
FIG. 6 is a side view of a lifeline of a flotation device during the method of integrating a boarding apparatus on a lifeline, in accordance with various embodiments.

Referring now to FIG. 5, a method of converting a lifeline to a boarding apparatus, in accordance with various embodiments, is depicted. In various embodiments, the method comprises disposing x number of heat shrink tubing on a portion of a lifeline (step 502). The number x, of heat shrink tubing, may be determined based on the desired number of steps in the boarding apparatus. In various embodiments, the number of steps may be between 3 and 10. The method further comprises folding the lifeline in half to form a bight at a second end of the lifeline (Step 504). A bight, as described herein, is a loop of rope opposite the two ends of the rope. With brief reference to FIG. 6, a lifeline 600 after step 504, in accordance with various embodiments, is depicted. Lifeline 600 has a first end 602 and a second end 604. Second end 604 comprises a bight. Next, an overhand knot is tied at the first end of the lifeline (step 506). An overhand knot is made by forming a loop and passing a free end around the standing part and through the loop.

Subsequently, the method further comprises pulling a portion of the lifeline on a first side of the bight longer than a portion of the lifeline on the second side of the bight (step 508). The method further comprises aligning a heat shrink tubing with a first loop created in step 508 (step 510). The method further comprises tying an overhand knot where the first loop has the heat shrink tubing within it (step 512). The heat shrink tubing may be substantially perpendicular to a central axis defined by a central portion of the lifeline. Then, steps 508, 510, and 512 are repeated until the second end is reached (step 514). Each heat shrink tubing is heated to shrink the tubing and stiffen each loop in the boarding apparatus (step 516). In various embodiments, the method further comprises removably coupling the second end of the boarding apparatus to a loop patch on a flotation device (step 518). The boarding apparatus is removably coupled to the loop patch by any method known in the art, such as a slipknot, a pin release system, or the like.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A flotation device comprising:

an inflation tube;

a plurality of loop patches disposed around a perimeter of the inflation tube;

a lifeline extending from adjacent loop patches in the plurality of loop patches, the lifeline extending along the perimeter of the inflation tube;

a lifeline configuration comprising a boarding apparatus extending from a first loop patch in the plurality of loop patches to a second loop patch in the plurality of loop patches, the boarding apparatus extending along the perimeter of the inflation tube; and a boarding configuration comprising the boarding apparatus extending from the first loop patch downward and perpendicular to the perimeter of the inflation tube.

2. The flotation device of claim 1, wherein an applied force along an axis of the boarding apparatus releases the boarding apparatus from the second loop patch.

3. The flotation device of claim 1, wherein the boarding apparatus further comprises:

a central rope having a first end and a second end, the first end coupled to the first loop patch;

a first loop proximate the first loop patch and disposed on a first side of the central rope;

a second loop proximate the first loop and disposed on a second side of the central rope, the second side being opposite the first; and a third loop proximate the second loop and disposed on the first side of the central rope.

4. The flotation device of claim 3, wherein the boarding apparatus further comprises a heat shrink tubing, wherein the heat shrink tubing is coupled to the first loop.

5. The flotation device of claim 1, wherein:

the boarding apparatus is removably coupled to the second loop patch, the boarding apparatus comprises a stirrup ladder, and the boarding apparatus is configured to release from the second loop patch downward into the boarding configuration.

* * * * *